United States Patent [19]

Farian

[11] Patent Number: 4,475,680

[45] Date of Patent: Oct. 9, 1984

[54] DRIVING APPARATUS FOR FASTENER ELEMENTS

[75] Inventor: Gerhard Farian, Grossbettlingen, Fed. Rep. of Germany

[73] Assignee: Karl M. Reich Maschinenfabrik GmbH, Nuertingen, Fed. Rep. of Germany

[21] Appl. No.: 328,595

[22] PCT Filed: Apr. 2, 1981

[86] PCT No.: PCT/DE81/00054

§ 371 Date: Nov. 23, 1981

§ 102(e) Date: Nov. 23, 1981

[87] PCT Pub. No.: WO81/02992

PCT Pub. Date: Oct. 29, 1981

[30] Foreign Application Priority Data

Apr. 16, 1980 [DE] Fed. Rep. of Germany ..... 3014535

[51] Int. Cl.[3] ..... B25C 1/04

[52] U.S. Cl. ..... 227/130; 173/139; 227/156

[58] Field of Search ..... 173/139; 227/130, 156

[56] References Cited

U.S. PATENT DOCUMENTS

| | | | |
|---|---|---|---|
| 2,887,686 | 5/1959 | Wandel et al. | 173/139 |
| 3,179,185 | 4/1965 | O'Farrell | 173/139 |
| 3,434,643 | 3/1969 | Wandel | 227/130 |
| 3,496,840 | 2/1970 | Wandel et al. | 173/139 |
| 3,504,840 | 4/1970 | Wandel et al. | 227/130 |
| 3,559,753 | 2/1971 | Meri | 173/139 |
| 3,565,351 | 2/1971 | Ross, Jr. | 173/139 |
| 3,567,098 | 3/1971 | Maynard | 227/130 |
| 3,871,566 | 3/1975 | Elliesen et al. | 227/130 |
| 4,131,165 | 12/1978 | Wanner et al. | 173/139 |
| 4,310,055 | 12/1982 | Wanner et al. | 173/139 |

*Primary Examiner*—Frank T. Yost
*Assistant Examiner*—Hien H. Phan
*Attorney, Agent, or Firm*—W. G. Fasse; D. H. Kane, Jr.

[57] ABSTRACT

A pot shaped housing insert (6) is arranged in a driving apparatus for fastener elements, such as nails, between a pot shaped main body (2) and the driving cylinder (12). In such a driving apparatus the excess driving energy is taken up by an impact buffer (11) made of elastic material. The housing insert (6) is made of a synthetic material having a high inner damping, so that the excess driving energy and thus the impact noise are dissipated to a large extent already in the housing insert (6). Thus, the operator is not exposed to any unnecessary nuisance and the housing (1) may be manufactured more easily in an economical manner at lesser expense.

5 Claims, 1 Drawing Figure

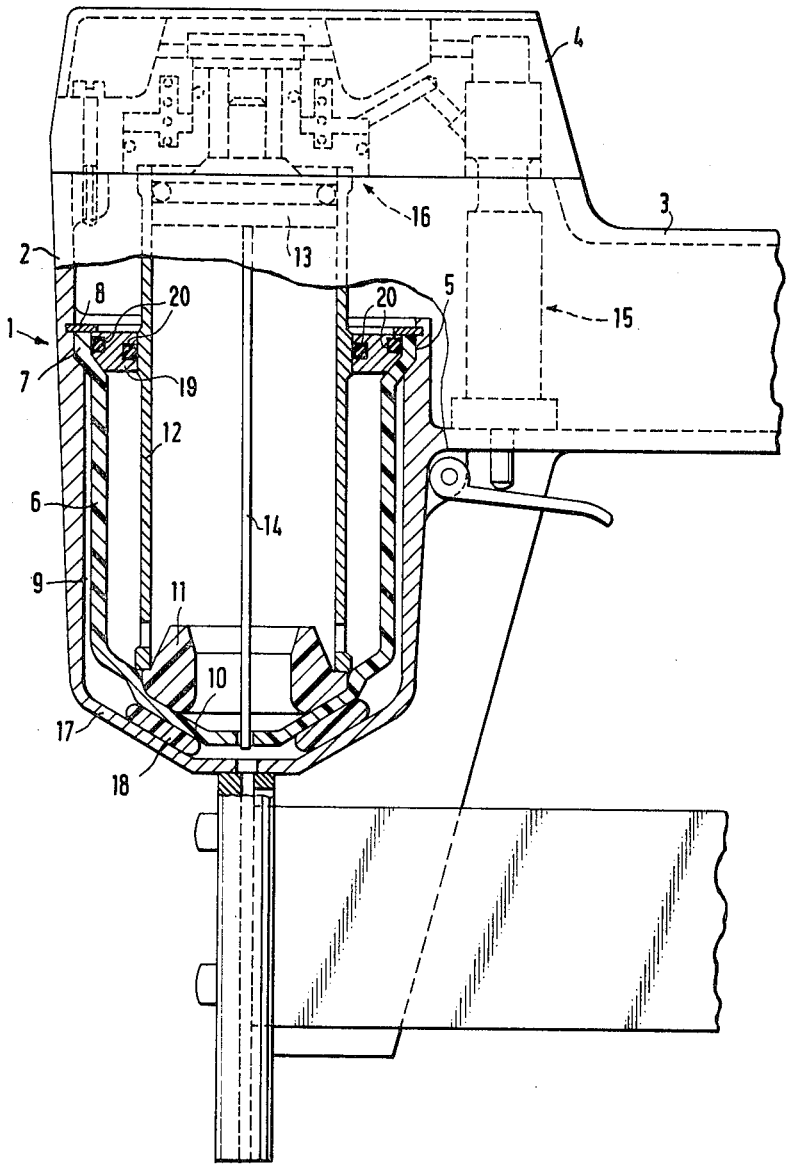
4
3
16
13
2
8
20
20
5
15
1
7
19
12
6
14
9
11
10
17
18

DRIVING APPARATUS FOR FASTENER ELEMENTS

BACKGROUND OF THE INVENTION

1. Field of the Invention

The invention relates to a driving apparatus for fastener elements, such as nails to be driven into a work piece.

2. Description of the Prior Art

In driving devices of this type the excess driving energy or the driving energy of idle strokes is taken up and dissipated by an impact buffer made of elastic material. However, in such devices a very loud impact noise is generated which is radiated by the buffer through the housing to the environment. The operator is exposed to a substantial nuisance by this impact noise due to its high intensity and the high stroke frequency. Thus, it has already been attempted to reduce this noise by using impact buffers of relatively soft, elastic material. It is also known to coat the housing and other parts of the driving apparatus, which are normally made of light metal, with a suitable damping material.

Impact buffers made of soft material, however, have a high wear and tear and must be quickly replaced. Additionally, depending on the solidity of the work piece, for example, of wood, the fastener means may be driven to differing depths where an impact buffer of soft material is used. Such a feature is especially disadvantageous, for example in connection with nails having visible nail heads.

A coating with damping materials is not possible with regard to all parts of the driving apparatus. Thus, in such an instance the noise damping is only incomplete.

OBJECT OF THE INVENTION

Accordingly, it is the object of the invention to provide a driving apparatus for fastener elements in which the damping of the impact noise is as large as possible without impairing the customary useful life of the impact buffer.

SUMMARY OF THE INVENTION

This objective has been achieved in that a housing insert having a pot shape is arranged between the main outer housing member and the driving cylinder.

This housing insert prevents that the impact noise is transmitted to the housing and thus to the environment. The housing insert is separated from the inner wall of the main body in the area of the impact buffer. The impact buffer rests on the bottom of this insert. If the housing insert is made according to the invention of a synthetic material having a high inner damping, the excess impact energy and thus also the impact noise, are dissipated to a large extent already in the housing insert.

Accordingly, the excess impact energy cannot be transmitted to the outer housing member and the latter can be made of a less expensive material. The housing can also be so constructed that its manufacture is more economical and so that the entire driving apparatus may have a smaller weight.

BRIEF FIGURE DESCRIPTION

An example embodiment of the invention is described in more detail in the following with reference to the drawing, wherein the single FIGURE shows a driving apparatus according to the invention partially in section.

DETAILED DESCRIPTION OF A PREFERRED EXAMPLE EMBODIMENT AND OF THE BEST MODE OF THE INVENTION

A driving apparatus comprises in a known manner an outer housing member 1 including a pot shaped main housing body 2 and a hollow handle grip 3 connected to the housing. Air pressure is supplied through the handle grip 3 from a source of air pressure not shown. The main housing body 2 is closed at the top by a housing cover 4.

The main housing body 2 comprises forming a shoulder against its upper zone a recess 5 in which a pot shaped housing insert 6 is supported by means of a ring flange 7 of the insert 6. A snap ring 8 holds the flange 7 of the housing insert 6 against the shoulder in the outer housing body 2. The cross-section of the housing insert 6 is so dimensioned that an intermediate space 9 is present between the main housing body 2 and the housing insert 6.

The housing insert 6 comprises at its impact facing end a slanted bottom 10. An impact buffer 11 of elastic synthetic material rests on the slanted body 10. The intermediate space 9 extends also in the area of the bottom 10 and the main housing body 2.

The housing insert 6 is preferably made of the synthetic materials polyamide or polypropylene, whereby especially polypropylene has a high inner damping caused by internal friction which absorbs noise.

The driving cylinder 12 is supported between the housing cover 4 and the bottom 10 of the housing insert 6. The driving cylinder 12 guides the driver piston 13 having a driving rod 14 which serves in a known manner for the driving of fastener elements not shown. The release and control of the driving stroke is accomplished by the known release valve 15 and control valve 16 which are not described in detail.

A spacer ring 19 with sealing rings 20 is arranged between the upper end of the insert 6 and the driving cylinder 12, whereby the spacer ring 19 holds the insert 6 against the shoulder of the outer housing member. The lower end of the driving piston 12 holds the impact buffer 11 against the inner bottom surface of the insert 6.

In operation the driving piston 13 impacts on the impact buffer 11 thereby producing an impact noise which is partially dissipated by the inner damping of the housing insert 6 and which is further damped by the intermediate space 9 between the housing insert 6 and the main housing body 2.

For supporting and fixing the housing insert 6 a support cushion 18 of elastic material may be provided between the bottom 10 of the housing insert 6 and the bottom 17 of the main housing body 2. Such material also has a high inner damping. Therefore, the noise generated in the support bottom 10 cannot be transmitted into the main housing body 2. Rather, the support cushion 18 provides for an additional damping of the impact noise.

Although the invention has been described with reference to a specific example embodiment, it will be appreciated, that it is intended, to cover all modifications and equivalents within the scope of the appended claims.

I claim:

1. An apparatus for driving fastener elements, comprising housing means including an outer housing member (2) having an inwardly facing shoulder, a driving cylinder (12) centrally located inside said outer housing member, a driving piston (13) displaceably supported in said driving cylinder, impact buffer means (11), said driving cylinder having an impact facing end, said impact buffer means being arranged at said impact facing end of said driving cylinder, pot shaped insert means (6) made of damping material and having an outwardly reaching flange, said insert means (6) being operatively arranged inside said outer housing member (2) between said driving cylinder (12) and said outer housing member with said flange (7) resting against said shoulder for holding said insert means (6) of damping material in said outer housing member in a stationary position, said impact buffer means (11) resting on a bottom of said pot shaped insert means (6), for effectively damping any impacting noise by the cooperation between said impact buffer (11) providing mechanical impact damping and said insert means (6) of damping material providing noise dissipation.

2. The apparatus of claim 1, comprising further buffer means (18) in the form of a support cushion made of elastic material arranged between the bottom (10) of said pot shaped insert means (6) and the bottom (17) of said outer housing member (2) for keeping said pot shaped insert means spaced from an inner wall of said outer housing member at least adjacent said bottom of said pot shaped insert means near said first mentioned impact buffer means.

3. The apparatus of claim 1, further comprising a ring member (19) interposed between said driving cylinder (12) and said pot shaped insert means (6) for holding said flange (7) against said shoulder.

4. The apparatus of claim 1, wherein said pot shaped insert means (6) is made of a synthetic material having a high inner damping for producing heat by internal friction causing said inner damping for an efficient noise dissipation.

5. An apparatus for driving fastener elements, comprising housing means including an outer housing member (2) having an inwardly facing shoulder, a driving cylinder (12) centrally located inside said outer housing member, a driving piston (13) displaceably supported in said driving cylinder, impact buffer means (11), said driving cylinder having an impact facing end supported by said impact buffer means, pot shaped insert means (6) made of damping material and having an outwardly reaching flange, said insert means (6) being operatively arranged inside said outer housing member (2) between said driving cylinder (12) and said outer housing member with said flange (7) resting against said shoulder for holding said insert means (6) of damping material in said outer housing member in a stationary position, said impact buffer means (11) resting on a bottom of said pot shaped insert means (6), whereby said driving cylinder is supported with its impact facing end inside said pot shaped insert means for effectively damping any impacting noise by the cooperation between said impact buffer (11) providing mechanical impact damping and said insert means (6) of damping material providing noise dissipation.

* * * * *